US011313541B2

(12) United States Patent
Patel

(10) Patent No.: US 11,313,541 B2
(45) **Date of Patent: *Apr. 26, 2022**

(54) LUMINAIRE

(71) Applicant: Hubbell Incorporated, Shelton, CT (US)

(72) Inventor: Dhavalkumar Patel, Greer, SC (US)

(73) Assignee: Hubbell Lighting, Inc., Shelton, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/819,874

(22) Filed: Mar. 16, 2020

(65) Prior Publication Data

US 2020/0217486 A1 Jul. 9, 2020

Related U.S. Application Data

(63) Continuation of application No. 16/538,217, filed on Aug. 12, 2019, now Pat. No. 10,591,140, which is a (Continued)

(51) Int. Cl.
*F21V 17/16* (2006.01)
*F21V 15/015* (2006.01)
(Continued)

(52) U.S. Cl.
CPC ..... *F21V 17/164* (2013.01); *F21V 15/015* (2013.01); *F21V 19/004* (2013.01); *F21Y 2103/10* (2016.08); *F21Y 2115/10* (2016.08)

(58) Field of Classification Search
CPC .... F21V 17/164; F21V 19/004; F21V 15/015; F21V 5/04; F21V 7/005; F21V 7/043; F21Y 2103/10; F21Y 2115/10; F21K 9/00; F21K 9/20; F21S 4/00; F21S 4/20; F21S 4/28
See application file for complete search history.

(56) References Cited

U.S. PATENT DOCUMENTS 10,125,934 B1 11/2018 Zhang
10,591,140 B2 * 3/2020 Patel ..... F21V 17/164
(Continued)

*Primary Examiner* — Joseph L Williams
*Assistant Examiner* — Jose M Diaz
(74) *Attorney, Agent, or Firm* — Michael Best & Friedrich LLP

(57) ABSTRACT

A luminaire includes an elongated first housing, an elongated second housing, and a bracket. The elongated first housing supports a first light emitting device and includes a pair of sides and a first channel defined between the sides. The first housing includes a first aperture. The elongated second housing includes a pair of sides and a second channel defined between the sides. An end of the second housing is positioned adjacent an end of the first housing and includes a second aperture disposed proximate the first aperture. The bracket is disposed between the elongated first housing and the first light emitting element. The bracket includes a first projection engageable with the first aperture and a second projection engageable with the second aperture. The bracket is positioned partially within the first channel and partially within the second channel. The bracket is coupled to the first housing by snap-fit engagement and the bracket is coupled to the second housing by snap-fit engagement.

18 Claims, 16 Drawing Sheets

Related U.S. Application Data continuation of application No. 15/923,482, filed on Mar. 16, 2018, now Pat. No. 10,378,735.

(51) Int. Cl.

| | |
|---|---|
| ***F21V 19/00*** | (2006.01) |
| ***F21Y 115/10*** | (2016.01) |
| ***F21Y 103/10*** | (2016.01) |

(56) References Cited

U.S. PATENT DOCUMENTS

| | | | |
|---|---|---|---|
| 2012/0092875 | A1 | 4/2012 | Cho |
| 2015/0338053 | A1 | 11/2015 | Rector |
| 2016/0116143 | A1 | 4/2016 | Li |
| 2017/0051905 | A1 | 2/2017 | Luu |
| 2017/0097142 | A1 | 4/2017 | Sanfacon |
| 2017/0268756 | A1 | 9/2017 | Chami |
| 2017/0276332 | A1 | 9/2017 | Pearson |
| 2018/0080635 | A1 | 3/2018 | Zanotto |
| 2018/0119902 | A1 | 5/2018 | Dai |
| 2018/0135817 | A1 | 5/2018 | Germain |
| 2018/0142876 | A1 | 5/2018 | Sieczkowski |
| 2018/0172246 | A1 | 6/2018 | Walker |
| 2018/0299082 | A1 | 10/2018 | Li |
| 2018/0320885 | A1 | 11/2018 | Musser |

* cited by examiner

LUMINAIRE

REFERENCE TO RELATED APPLICATION

The present application is a continuation of co-pending, prior-filed U.S. patent application Ser. No. 16/538,217, filed Aug. 12, 2019, which is a continuation of U.S. patent application Ser. No. 15/923,482, filed Mar. 16, 2018. The entire contents of these applications are incorporated by reference.

TECHNICAL FIELD

The present disclosure relates to a luminaire, and more specifically to a housing and lens for a luminaire.

SUMMARY

In one embodiment, a luminaire includes an elongated first housing, an elongated second housing, and a bracket. The elongated first housing supports a first light emitting device and includes a pair of sides and a first channel defined between the sides. The first housing includes a first aperture. The elongated second housing includes a pair of sides and a second channel defined between the sides. An end of the second housing is positioned adjacent an end of the first housing and includes a second aperture disposed proximate the first aperture. The bracket includes a first projection engageable with the first aperture and a second projection engageable with the second aperture. The bracket is positioned partially within the first channel and partially within the second channel. The bracket is coupled to the first housing by snap-fit engagement and the bracket is coupled to the second housing by snap-fit engagement.

In another embodiment, a luminaire includes a housing, a lens removably coupled to the housing, a pocket, and a protuberance. The housing includes a pair of parallel sides, a channel defined between the sides, and a mounting bracket supporting a light emitter. The lens includes parallel side portions. The pocket is positioned on one of the side portions of the lens and the sides of the housing. The protuberance is positioned on the other of the side portions of the lens and the sides of the housing. The protuberance is engageable with the one pocket to couple the lens to the housing.

In yet another embodiment, a luminaire includes at least one housing, a first lens removably coupled to the at least one housing, a second lens removably coupled to the at least one housing, and a connector. The at least one housing includes a pair of sides, a channel defined between the sides, and a mounting bracket supporting a light emitting device. An end of the second lens is positioned adjacent an end of the first lens at an interface. The connector is positioned between the mounting bracket and the first lens. The connector includes a surface extending across the interface between the first lens and the second lens to inhibit light from passing through a space between the first lens and the second lens.

Other aspects of the disclosure will become apparent by consideration of the detailed description and accompanying drawings.

DETAILED DESCRIPTION

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Unless specified or limited otherwise, the terms "mounted," "connected," "supported," and "coupled" and variations thereof are used broadly and encompass both direct and indirect mountings, connections, supports, and couplings.

In general, the present disclosure relates to a luminaire having multiple housing portions coupled to one another. The disclosure also relates to a lens coupled to a housing, and a connector for covering a gap between adjacent lens portions. Brackets are positioned within the luminaire for coupling the housings and lenses together and providing an aesthetically pleasing view of the luminaire, and in some embodiments the connecting structures are not visible in the fully assembled luminaire.

Figure 1:
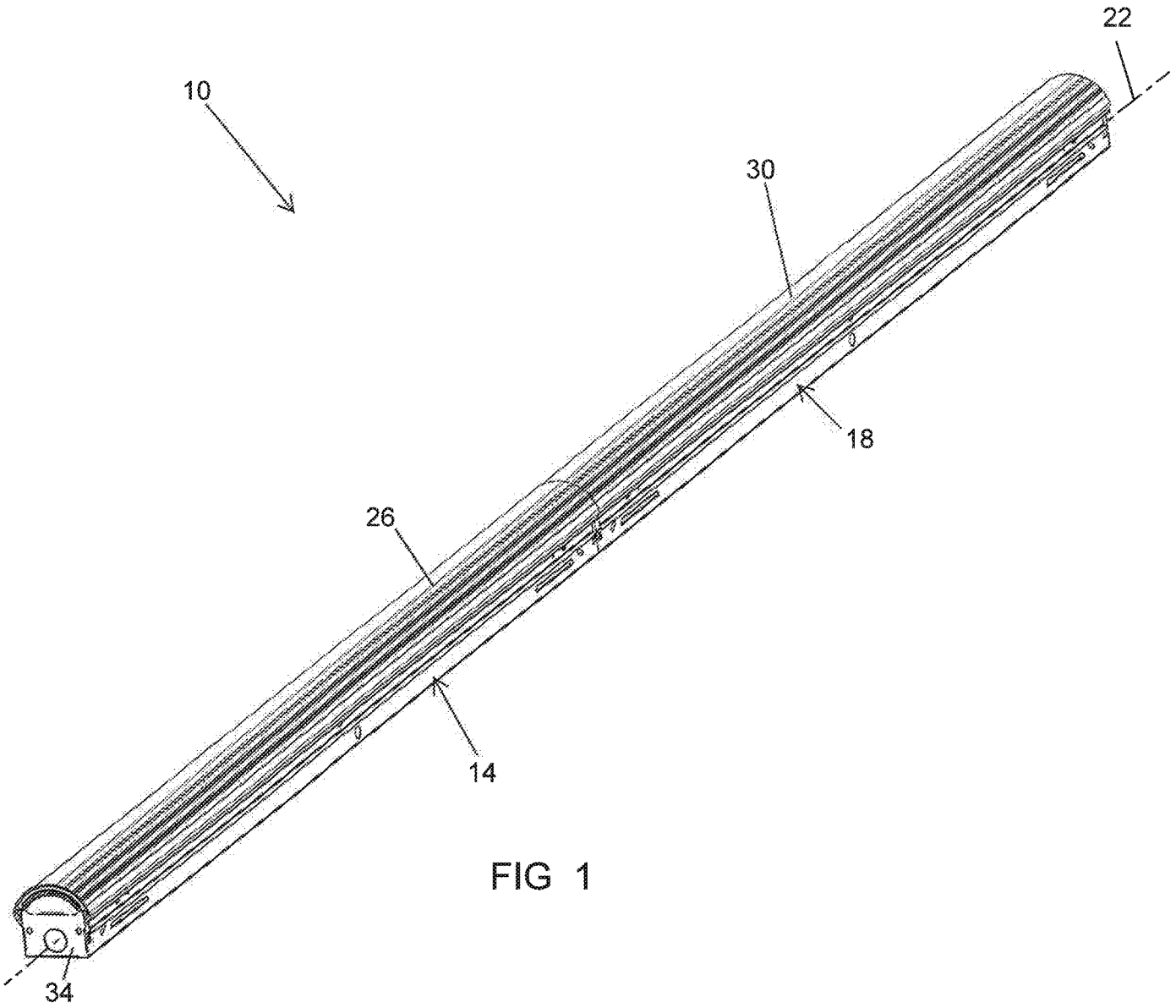
FIG. 1 is a perspective view of a luminaire.

As shown in FIG. 1, a luminaire 10 includes a first housing 14 coupled to a second housing 18. Each housing 14, 18 has an elongated body and extends along an axis 22. A first lens 26 is coupled to the first housing 14 and a second lens 30 is coupled to the second housing 18. Each lens 26, 30 extends in a direction parallel to the axis 22 along a length of the associated housing 14, 18. In the illustrated embodiment, a first end cap 34 is coupled to an end of the first housing 14 and a second end cap (not shown) is coupled to an end of the second housing 18. The end caps 34 define an end surface of the luminaire oriented orthogonal to the axis 22.

Figure 4:
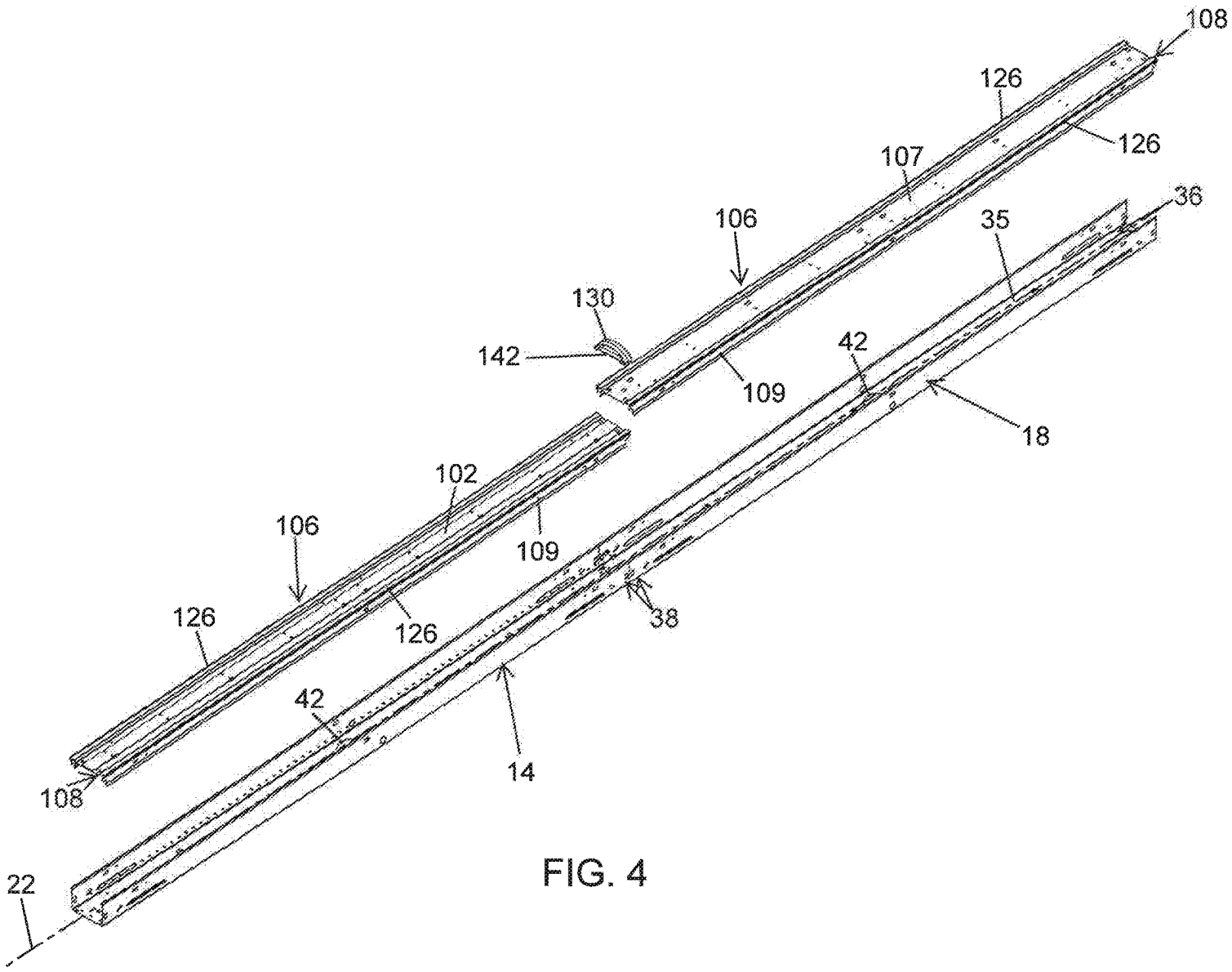
FIG. 4 is a partial exploded view of a housing of the luminaire of FIG. 1, with first and second lenses removed.
Figure 5:
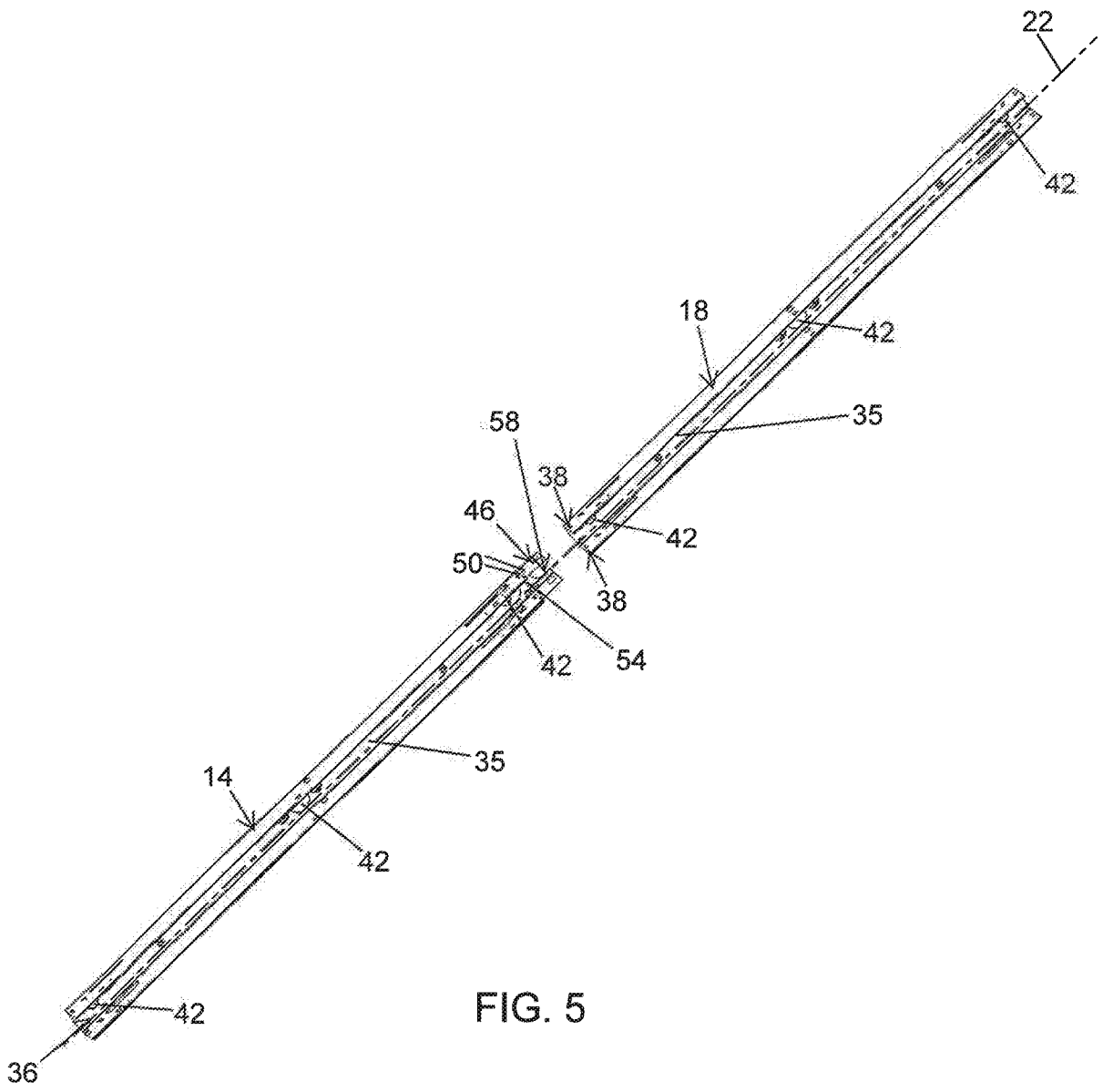
FIG. 5 is a partial exploded view of a first housing portion and a second housing portion.

As shown in FIGS. 4 and 5, in the illustrated embodiment, each housing 14, 18 has a substantially U-shaped cross-section, including two parallel side portions and a first portion 35 extending between the parallel side portions, orthogonal with respect to the two side portions. The U-shaped section forms a channel 36 that extends in a direction parallel to the axis 22. The housings 14, 18 include apertures 38 (shown on the second housing 18 in FIG. 5) and removable sections or knockouts 42 disposed along the surfaces. The apertures 38 permit communication (e.g., for wires) between an external environment and the channel 36 through one of the surfaces. The knockouts 42 may be detached from the respective housing 14, 18 to create an aperture (not shown) which further permits communication between the external environment and the channel 36.

Figure 6:
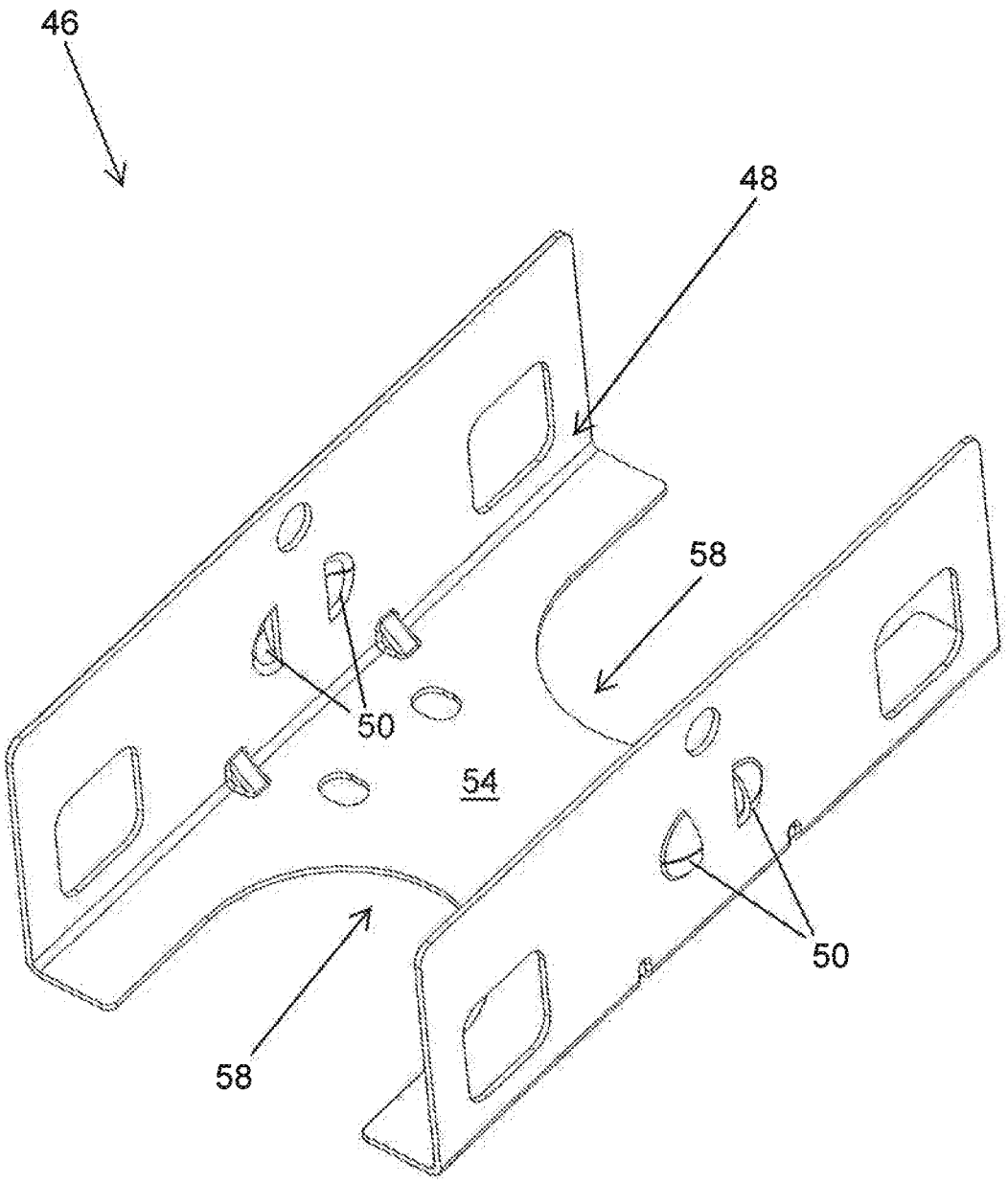
FIG. 6 is a perspective view of a row bracket.

A row bracket 46 couples the first housing 14 to the second housing 18. As shown in FIG. 6, the row bracket 46 includes a profile substantially similar to the profile of the housings 14, 18. In the illustrated embodiment, the row bracket 46 includes a substantially U-shaped cross-section, including two parallel side portions and a first surface 54 extending between the parallel side portions, orthogonal with respect to the two side portions. The U-shaped section forms a channel 48. In the illustrated embodiment, the first surface 54 includes two cutouts 58 positioned along edges of the first surface 54.

The row bracket 46 includes projections 50 that extend away from the channel 48. In the illustrated embodiment, the projections 50 are half-hemispheric in shape (i.e., each projection defines approximately one quarter of a sphere). Two projections 50 are disposed on either side of the channel 48.

As shown in FIG. 5, the row bracket 46 is positioned within the channel 36 so that the first surface 54 of the row bracket 46 is adjacent the first surface 35 of the housings 14, 18. The projections 50 are received within the apertures 38. The two projections 50 proximate a first end of the channel 48 each engage an aperture 38 on the first housing 14. The two projections 50 proximate a second end of the channel 48 each couple to an aperture 38 on the second housing 18. In the illustrated embodiment, the apertures 38 engage the projections 50 with a snap-fit. The row bracket 46 may couple the housings 14, 18 together without the use of fasteners (e.g., threaded screws), although fasteners can be used as an additional securing means. The cutouts 58 are positioned proximate knockouts 42 so that the row bracket 46 does not cover any knockouts 42. The cutouts 58 allow apertures (not shown) created by removing the knockouts 42 to provide communication to the channel 36 while the row bracket 46 is coupled to the housings 14, 18.

The row bracket 46 couples the first and second housings 14, 18 in an abutting, end-to-end relationship along the axis 22. The row bracket 46 couples the housings 14, 18 such that there is substantially little to no separation or gap between the housings 14, 18, thereby creating the appearance of a continuous luminaire 10. The snap-fit between the housings 14, 18 and the row bracket 46 allows a user to easily couple the housings 14, 18 together. Positioning the row bracket 46 within the channel 36 hides the connecting hardware (i.e., the row bracket 46) from view when the luminaire 10 is fully assembled.

Figure 8:
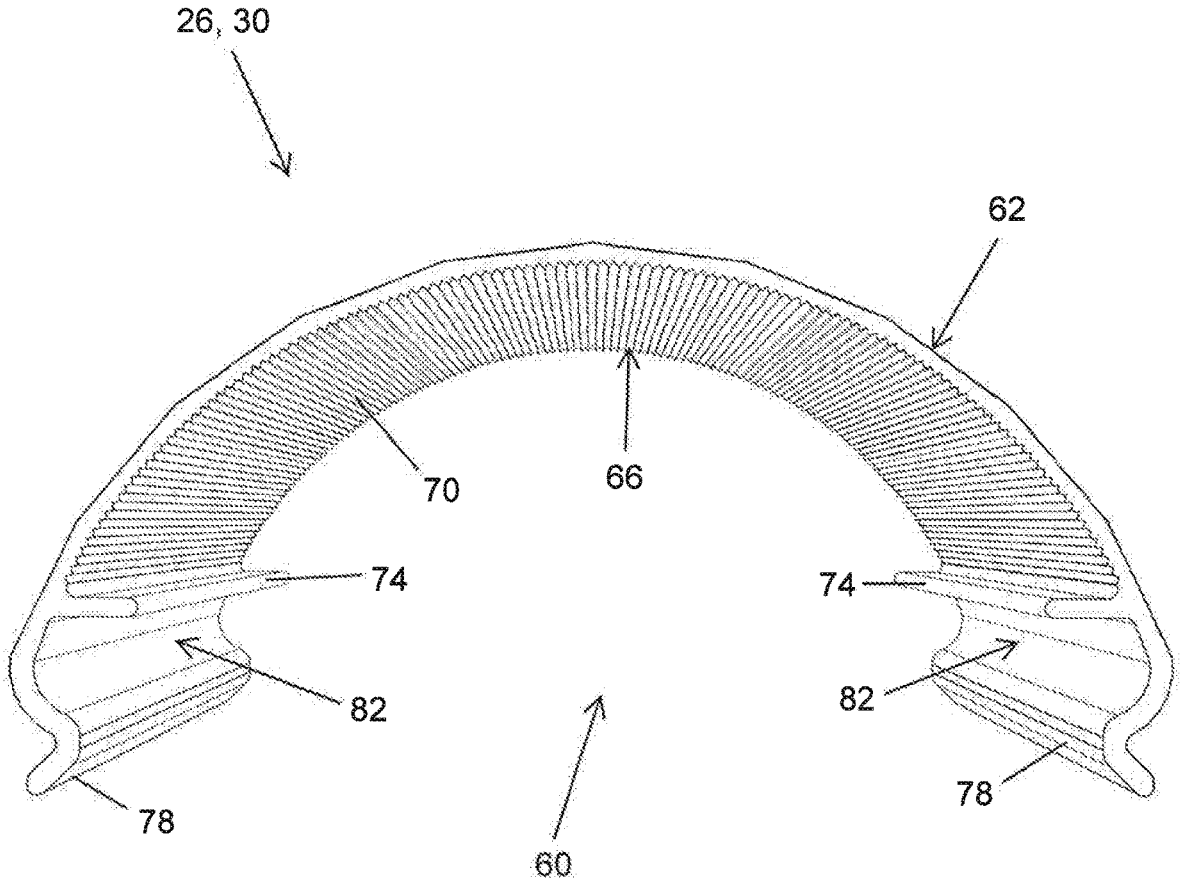
FIG. 8 is an end view of a lens having a curved profile.

As shown in FIG. 8, the lenses 26, 30 are open on three sides (e.g., a first end, a second end, and a bottom). In the illustrated embodiment, each of the lenses 26, 30 has a substantially semi-circular profile extending partially around a longitudinal axis, and a passage 60 extends between the ends of each lens. An external surface 62 may be substantially smooth and is disposed proximate the external environment. An internal surface 66 faces inwardly, opposite the external surface 62 and proximate the passage 60. In the illustrated embodiment, the internal surface 66 includes a ridged portion 70. Projections 74 protrude from the sides of the internal surface 66 into the passage 60. Bent portions 78 are positioned on either side of the passage 60 and a terminal end extends toward the external environment. Pockets 82 are positioned on each side of the passage 60 between the respective projection 74 and bent portion 78.

Figure 10:
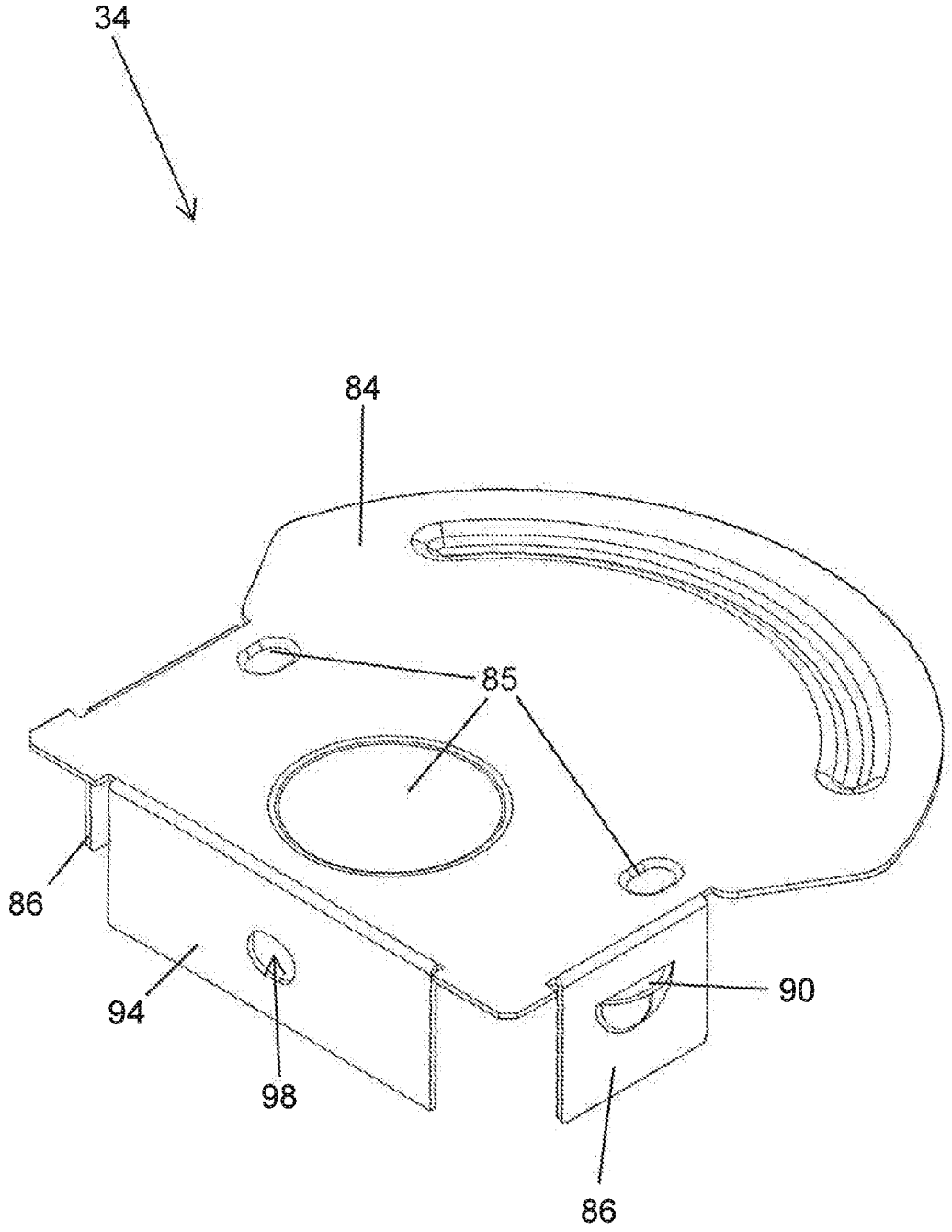
FIG. 10 is a perspective view of an end bracket.

As shown in FIG. 10, the end cap 34 has a main surface 84 with a profile substantially similar to a combination of the profiles of the housings 14, 18 and the lenses 26, 30. In other words, the end cap 34 has a rectangular portion adjacent a semi-circular portion. The end cap 34 is made from a frangible material (e.g., plastic) and includes removable sections or knockouts 85. The knockouts 85 may be detached from the end cap 34. Detaching a knockout 85 creates an aperture (not shown) which provides communication through the main surface 84.

The end cap 34 also has side surfaces 86 that are orthogonal to the main surface 84. In the illustrated embodiment, the side surfaces 86 are opposite one another and each include a projection 90 (only one shown). The projections 90 are similar to the projections 50 and are half-hemispheric in shape. The end cap 34 also includes a surface 94 with an aperture 98. The surface 94 is orthogonal to the side surfaces 86, as well as the main surface 84.

Figure 2:
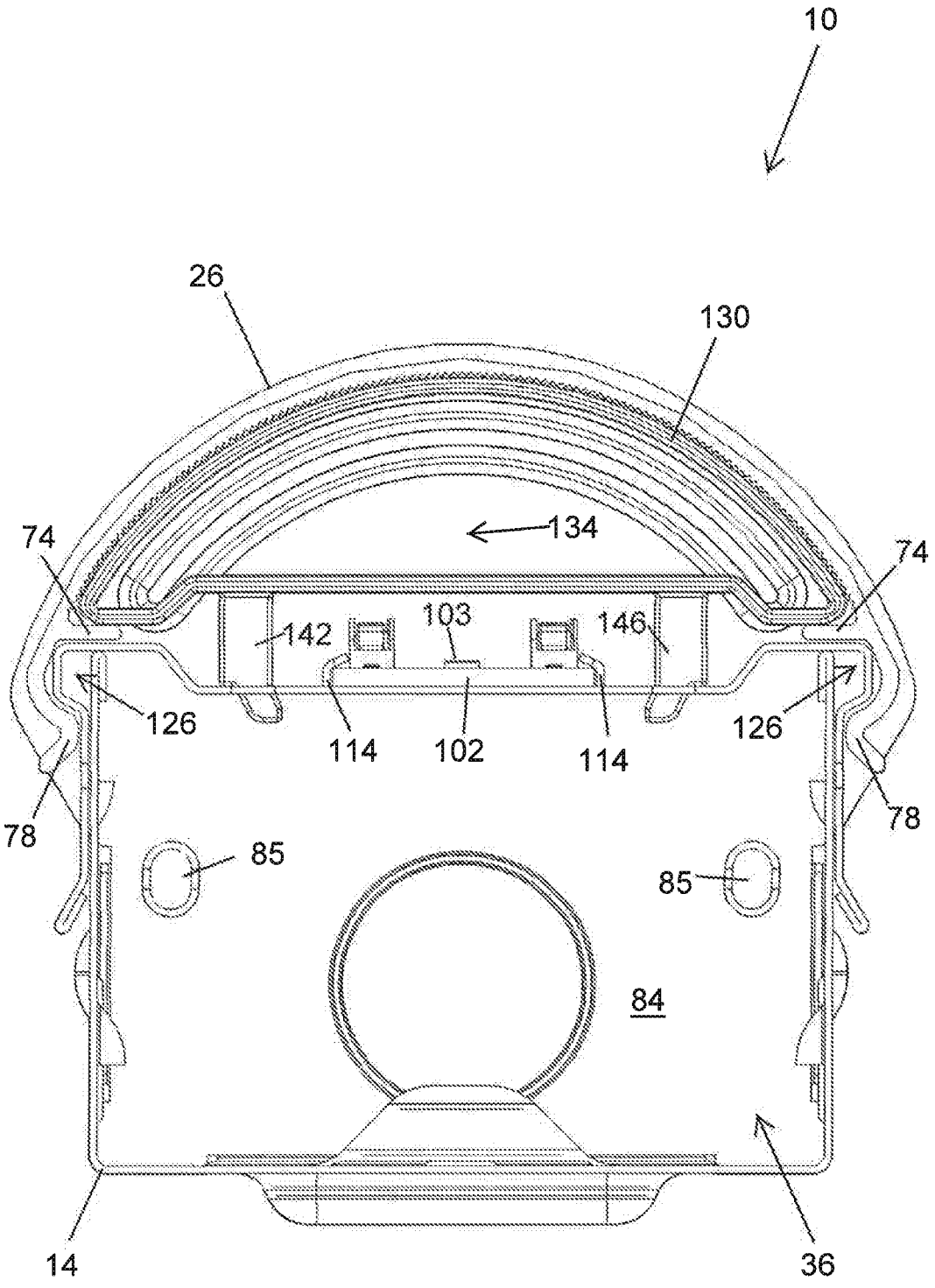
FIG. 2 is an end view of the luminaire of FIG. 1
Figure 3:
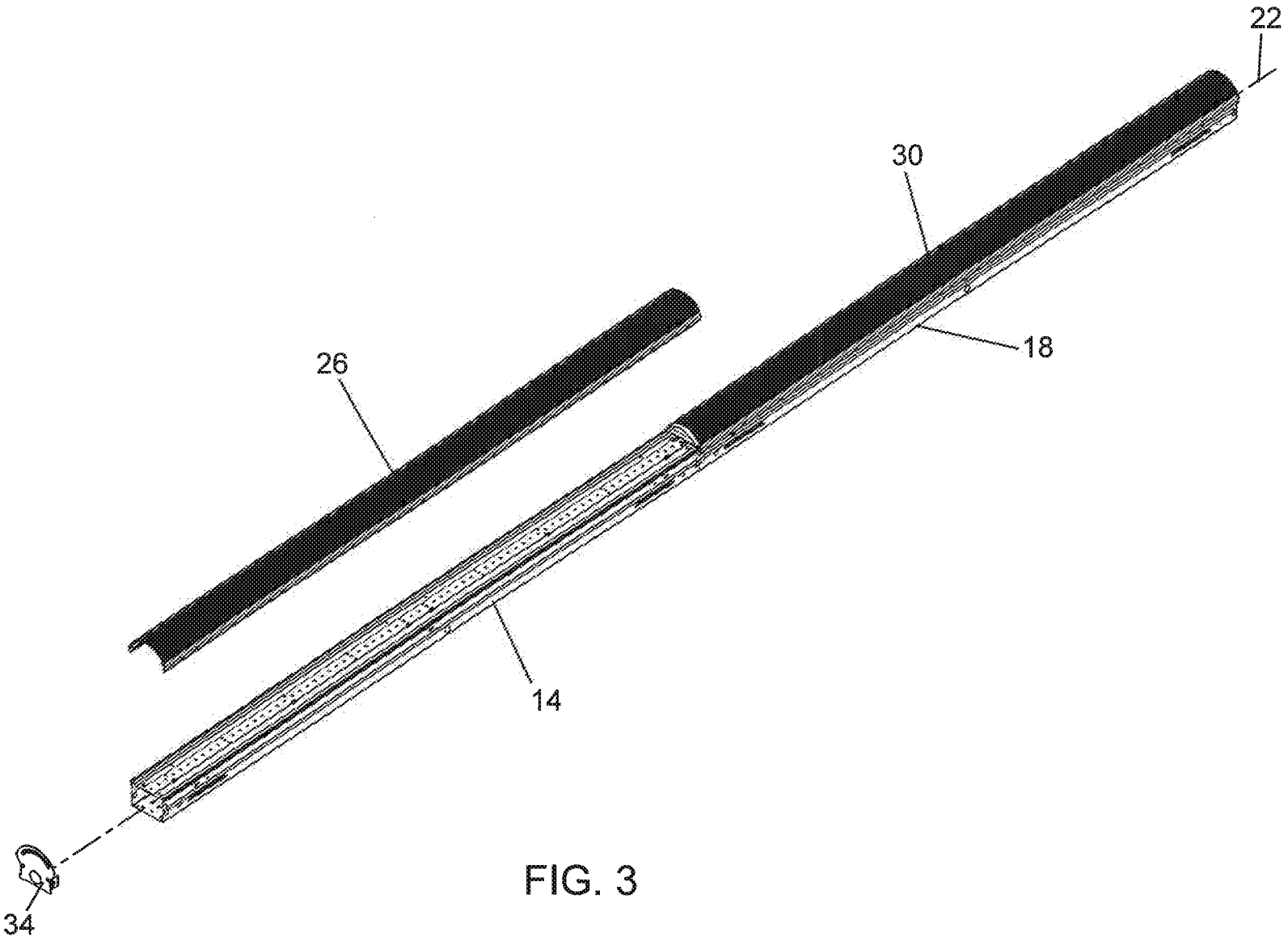
FIG. 3 is a partial exploded view of the luminaire of FIG. 1.

As shown in FIGS. 1-3, the lenses 26, 30 and the end caps 34 are coupled to the respective housings 14, 18. In the illustrated embodiment, light boards 102 are coupled to light mounting brackets 106 and are positioned within the luminaire 10 between the housings 14, 18 and the lenses 26, 30.

Figure 7:
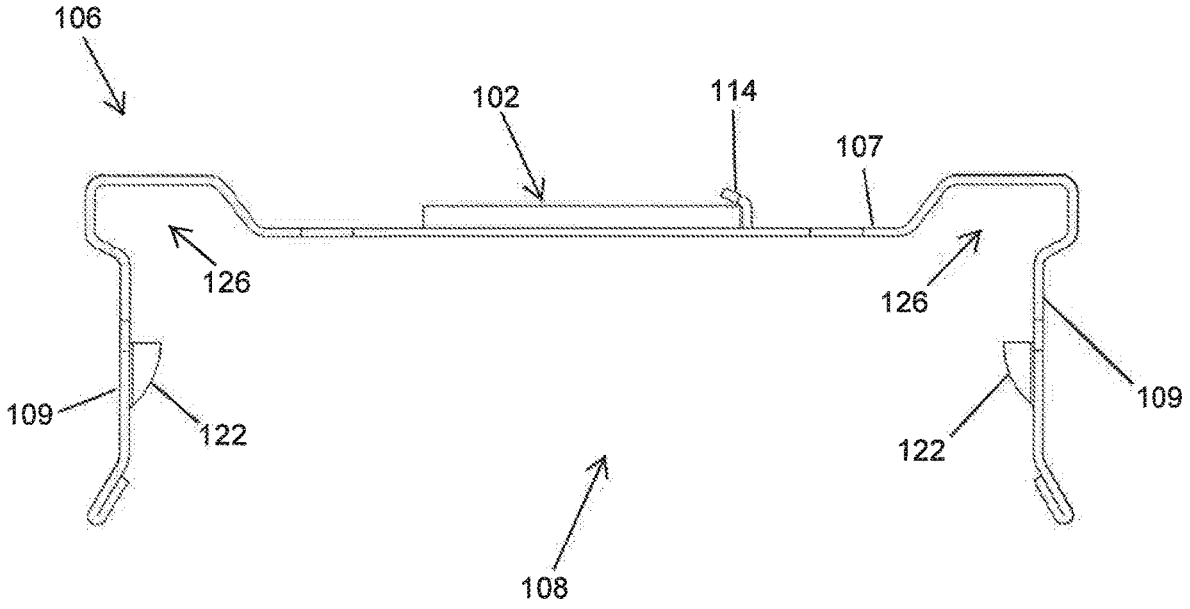
FIG. 7 is an end view of a mounting bracket.

Referring to FIG. 7, the light mounting bracket 106 includes a profile similar to the profile of the housings 14, 18. The light mounting bracket 106 includes a main surface 107 and side surfaces 109 positioned substantially orthogonal with respect to the main surface 107. In the illustrated embodiment, each light mounting bracket 106 is arranged in a substantially U-shaped arrangement and defines a passage 108. The main surface 107 of the light mounting bracket 106 includes one or more tabs 114. Light board(s) 102 are positioned on the main surface 107 of the light mounting bracket 106 and are secured against the main surface 107 by the tab(s) 114. The light board 102 includes at least one light emitting element 103 (FIG. 2). The light emitting element may be a light emitting diode (LED).

In the illustrated embodiment, projections 122 extend into the passage 108 from a face of each respective side surface 109 proximate the passage 108. The projections 122 are similar to projections 50 and are half-hemispheric in shape. Also, protuberances 126 are positioned between each of the side surfaces 109 and the main surface 107. In the illustrated embodiment, each protuberance 126 is formed adjacent the edge at which one of the side surfaces 109 joins the main surface 107. The protuberances 126 are raised or protrude beyond the main surface 107 and protrude beyond the respective side surfaces 109. In other embodiments, the light mounting bracket 106 may instead include a concave formation.

As shown in FIG. 4, a light mounting bracket 106 is coupled to each housing 14, 18 so that the side surfaces 109 of each light mounting bracket 106 are positioned proximate an external surface of each housing 14, 18. Stated another way, an opening to the U-shaped housing 14, 18 and the U-shaped light mounting bracket 106 are proximate one another so that channel 36 and passage 108 are substantially the same. The light mounting bracket 106 is also wider than the housings 14, 18. The projections 122 are received within apertures 38 of the housing 14, 18 and couple the light mounting brackets 106 to the respective housings 14, 18 (FIG. 2), e.g., by a snap-fit engagement.

Figure 9:
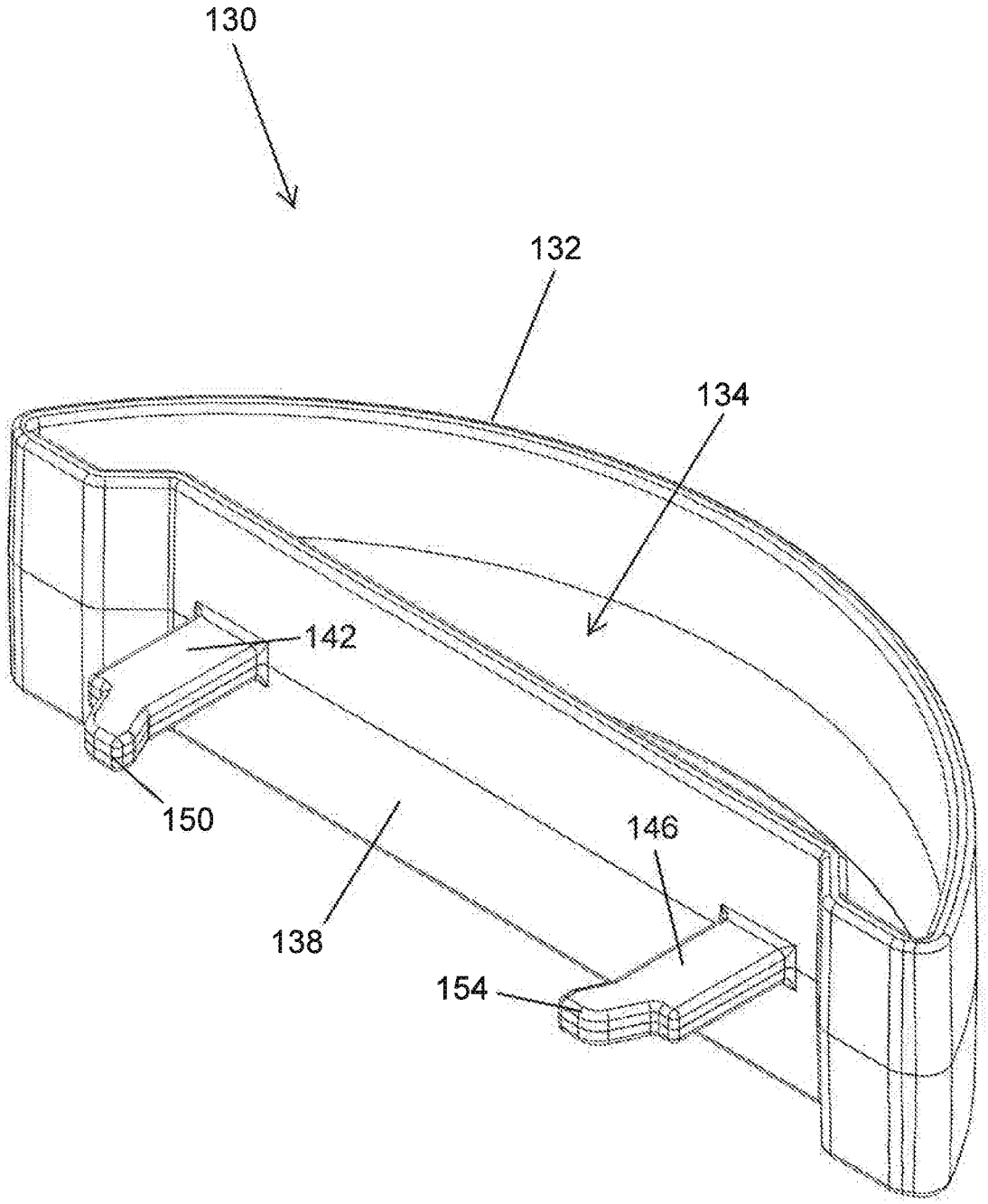
FIG. 9 is a perspective view of a lens connector having a curved profile.

A lens connector 130 is positioned adjacent an interface between the first lens 26 (FIG. 3) and the second lens 30. In the illustrated embodiment, the interface between the lenses 26, 30 coincides with an interface between the mounting brackets 106. As shown in FIG. 9, the lens connector 130 has an outer surface 132 having a profile that substantially conforms to the profile of the lens. In the illustrated embodiment, the profile is curvilinear (e.g., semi-circular, elliptical, etc.), and the outer surface 132 is formed on an outer flange and a recess 134 is formed between the flange and a base 138 of the lens connector 130. The outer surface 132 extends across a gap between the edges of the first lens 26 and the second lens 30 at the interface, thereby preventing light from "leaking" through the gap and facilitating a seamless appearance between the lenses 26, 30.

The base 138 includes a first extension 142 and a second extension 146. In the illustrated embodiment, the first extension 142 includes a first projection 150 and the second extension 146 includes a second projection 154. The projections 150, 154 are inclined with respect to their respective extensions 142, 146. The projections 150, 154 are also angled toward each other.

Returning to FIG. 2, the projections 150, 154 pass through holes (not shown) in the light mounting brackets 106 so that the lens connector 130 engages the light mounting bracket 106, e.g., by a snap-fit. In some embodiments, the end of each light mounting bracket 106 includes half of a hole, and a complete hole is formed by the abutment of the ends of the light mounting brackets 106 which aligns the halves of the holes with one another. The inclination of the projections 150, 154 secures the lens connector 130 to the light mounting brackets 106, so that the lens connector 130 cannot fall out of the holes.

The lenses 26, 30 are coupled to the housings 14, 18. In the illustrated embodiment, the lenses 26, 30 are coupled to their respective housings 14, 18 through the light mounting brackets 106. The pockets 82 of the lenses 26, 30 are substantially similar in shape to the protuberances 126 of the light mounting bracket 106, which allows one of the pockets 82 to engage or nest with an associated one of the protuberances 126. Each lens 26, 30 snaps onto one of the light mounting brackets 106 to couple the lens 26, 30 to the respective housing 14, 18. The pocket 82 receives the protuberance 126 so that a portion of the lens 26, 30 wraps around the protuberance 126. In the illustrated embodiment, each protuberance 126 has three sides. The projections 74 abut first surfaces of the protuberances 126 (e.g., planar surfaces adjacent the main surface 107) and the bent portions 78 abut second surfaces of the protuberance 126 (e.g., an inclined surface adjacent the side surface 109), thereby securing the protuberance 126 within the associated pocket 82. In the illustrated embodiment, the first surfaces of the protuberances 126 and the projections 74 are both substantially planar surfaces, and the projections 74 lie flat against the first surfaces of the protuberances 126. The bent portions 78 are inclined at substantially the same angle as the second surfaces of the protuberances 126, allowing the bent portions 78 and the second surfaces of the protuberances 126 to substantially mate (i.e., the bent portions 78 and the second surfaces substantially contact each other along their length).

Contact between the projections 74, the bent portions 78 and the respective surfaces of the protuberances 126 limit movement of the lens relative to the housing 14, 18 in directions that are non-parallel to the axis 22 (e.g., in a vertical direction as shown in FIG. 2). In the illustrated embodiment, the nesting arrangement forces direct contact between the projections 74, the bent portions 78, and the respective surfaces of the protuberances 126 while the lens 26, 30 is coupled to the light mounting bracket 106. The direct contact between these features 74, 78, 126 provides a snap-fit.

The snap fit between the lens 26, 30 and the housing 14, 18 (by way of the light mounting bracket 106) facilitates quick coupling of the lenses 26, 30 and housings 14, 18 together. Additionally, the snap-fit arrangement eliminates the need for tabs, lances, brackets and other connective hardware (not shown) required in conventional lens couplings. Eliminating connective hardware/features eliminates, or substantially reduces, dark spots and shadows caused by the connective hardware/features blocking light from exiting the lens. A user may also remove the lens 26, 30 by applying a force proximate either bent portion 78 of the lens 26, 30 to move the bent portion 78 away from the second surface of the protuberance 126, thereby allowing the lens 26, 30 to be separated from the housing.

Figure 11:
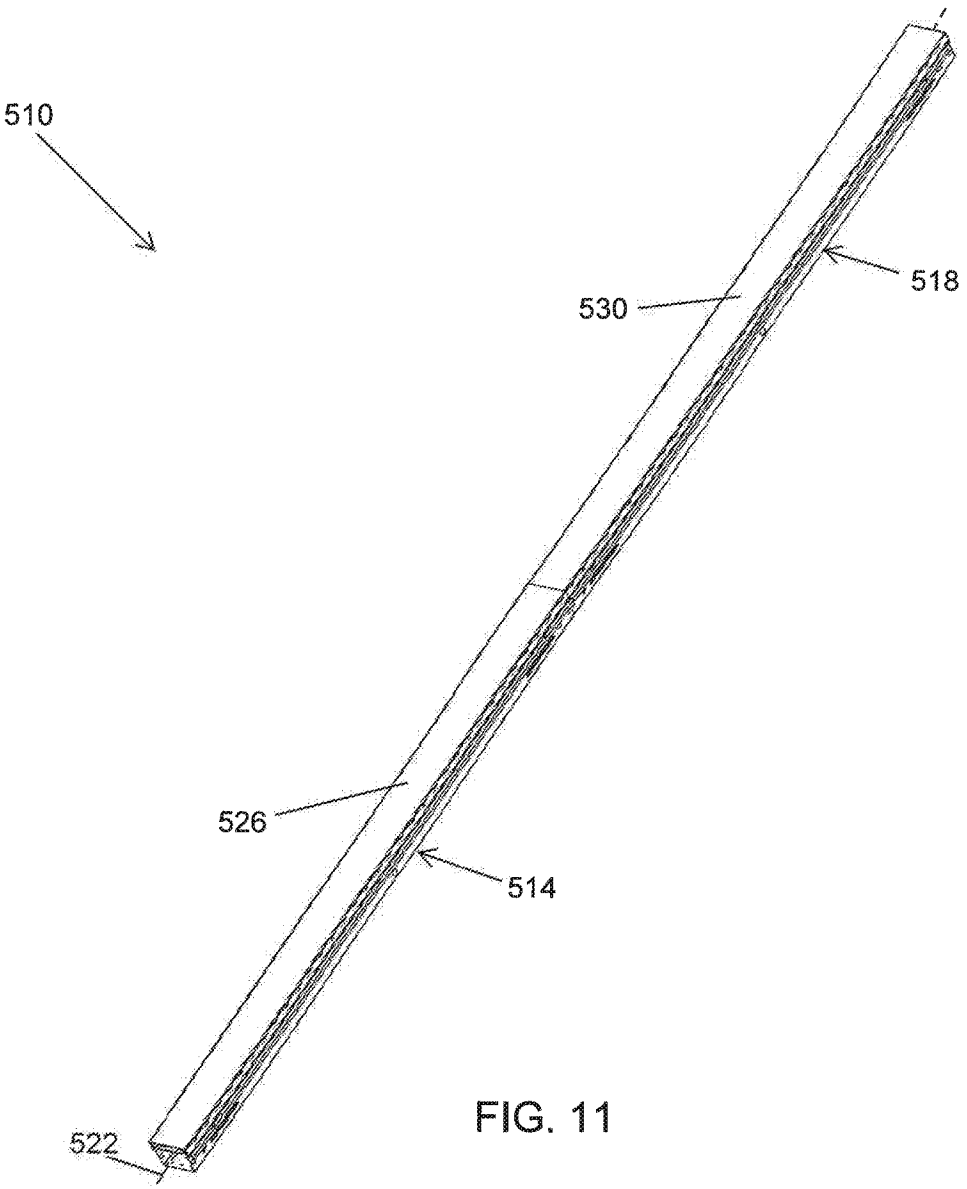
FIG. 11 is a perspective view of a luminaire according to another embodiment.
Figure 12:
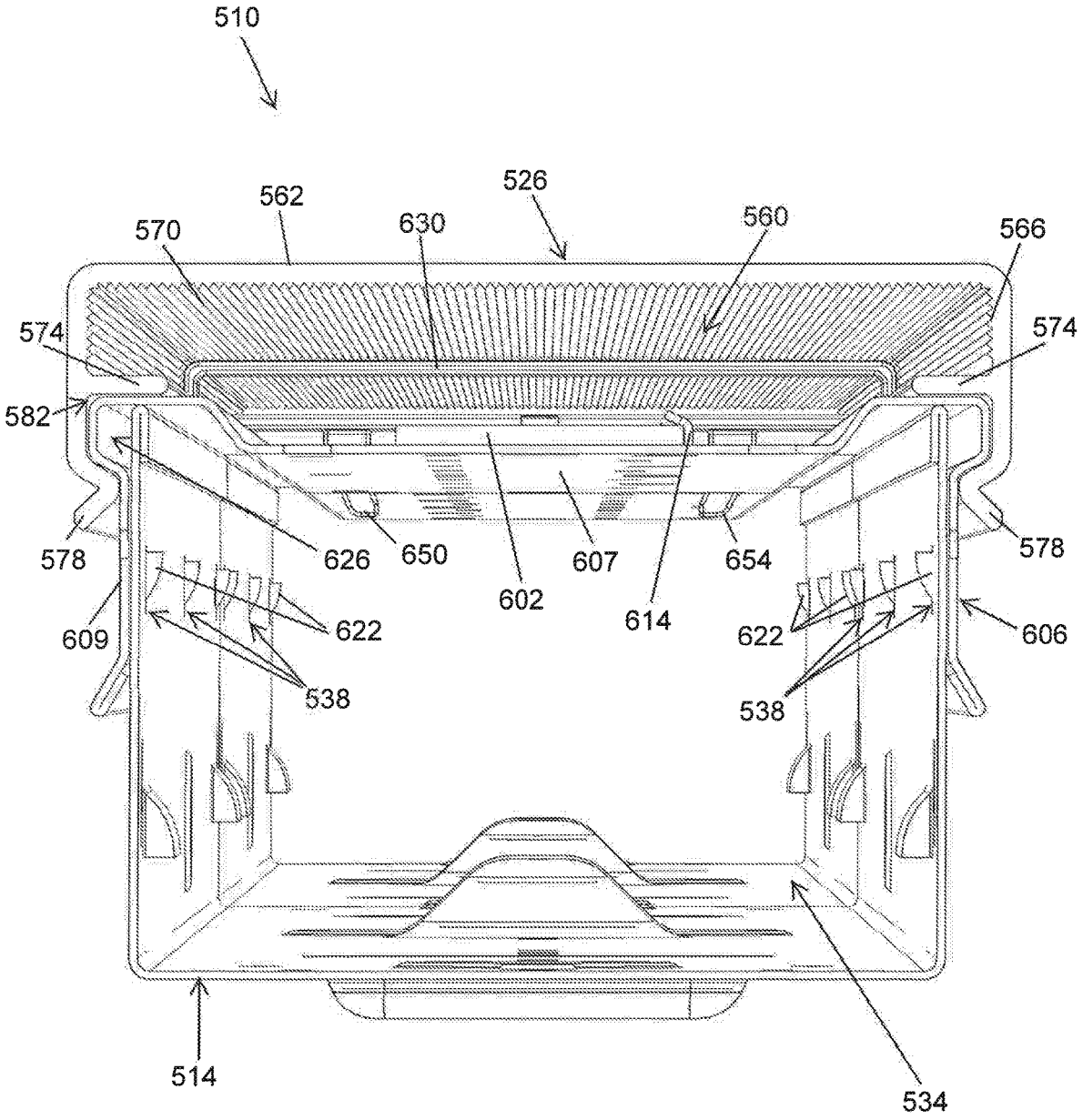
FIG. 12 is an end view of the luminaire of FIG. 11.
Figure 13:
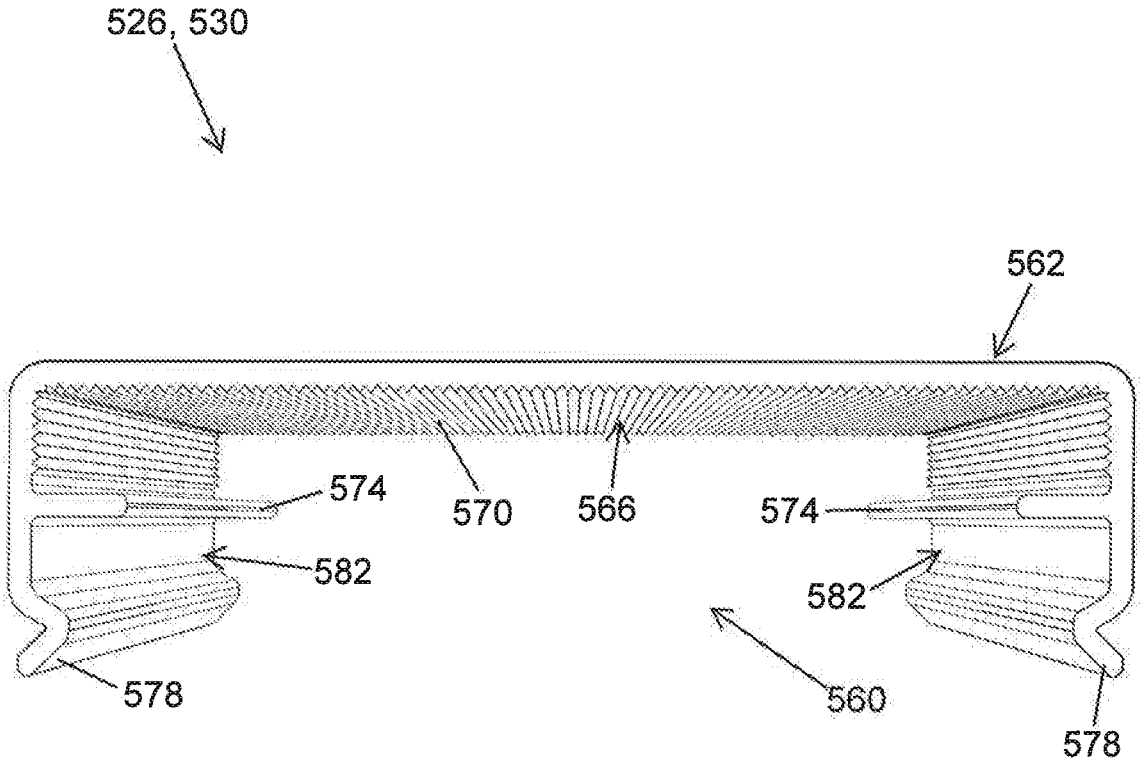
FIG. 13 is an end view of a lens having a flat profile.

FIGS. 11-13 illustrate a luminaire 510 according to another embodiment. At least some differences and similarities between luminaire 510 and luminaire 10 are described below. Similar features are identified with similar reference numbers, plus 500.

As shown in FIG. 11, a luminaire 510 includes a first housing 514 coupled to a second housing 518. Each housing 514, 518 has an elongated body and extends along an axis 522. A first lens 526 is coupled to the first housing 514 and a second lens 530 is coupled to the second housing 518. Each lens 526, 530 extends parallel to the axis 522.

As shown in FIGS. 12 and 13, the lenses 526, 530 are open on three sides. In the illustrated embodiment, each of the lenses 526, 530 has a substantially rectangular profile, and a passage 560 extends between the ends of each lens. An external surface 562 may be substantially smooth and is disposed proximate the external environment. An internal surface 566 faces inwardly, opposite the external surface 562 and proximate the passage 560. In the illustrated embodiment, the internal surface 566 includes a ridged portion 570. Projections 574 protrude from the internal surface 566 into the passage 560. In the illustrated embodiment, the projections 574 are orthogonal with respect to a portion of the internal surface 566. Bent portions 578 are positioned on either side of the passage 560 and a terminal end extends toward the external environment. Pockets 582 are positioned on each side of the passage 560 between the respective projection 574 and bent portion 578.

Figure 14:
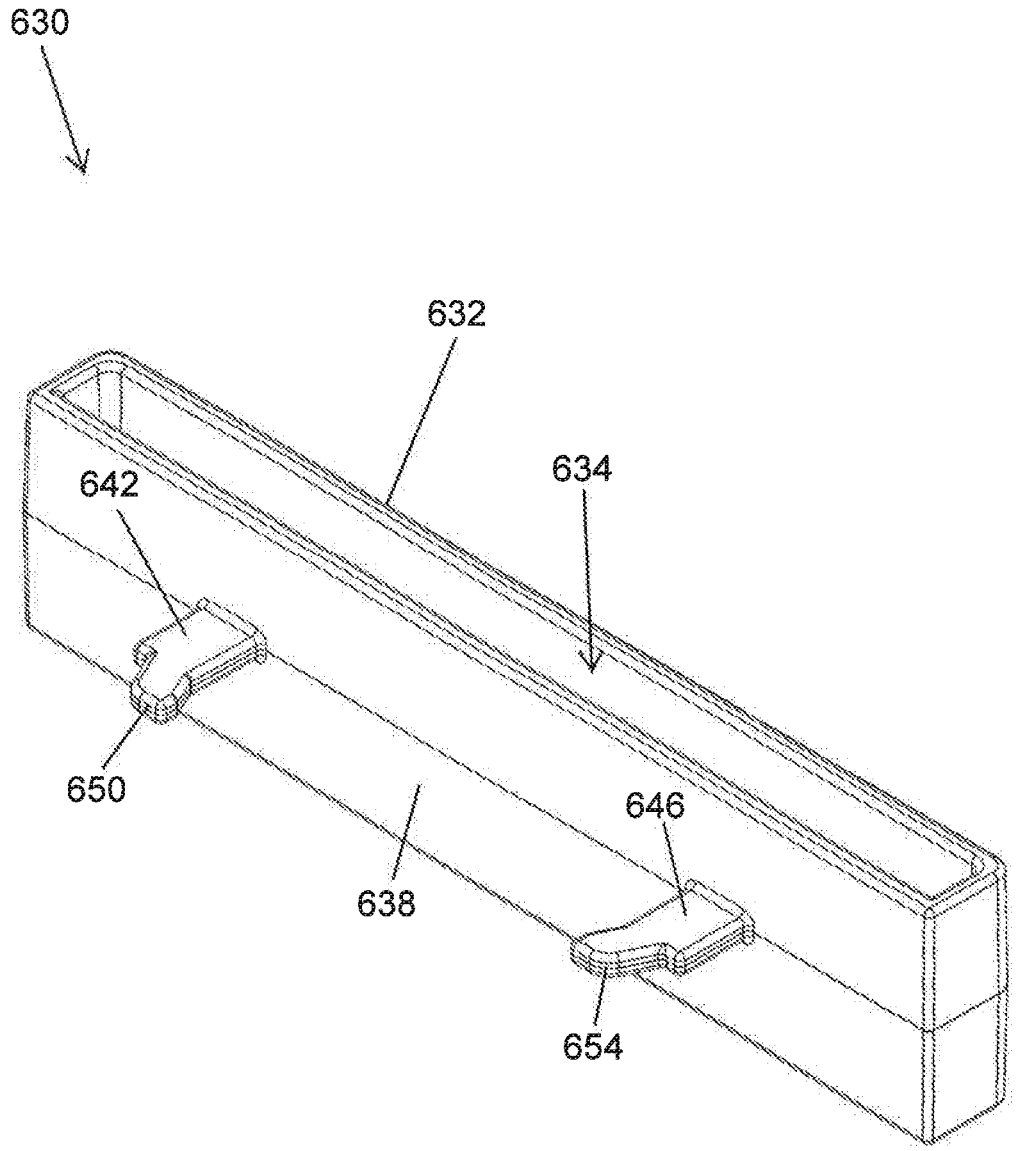
FIG. 14 is a perspective view of a lens connector having a flat profile.

As shown in FIG. 14, a lens connector 630 of the illustrated embodiment has an outer surface 632 having a profile that substantially conforms to the profile of the lens (i.e., a profile forming a portion of a rectangular shape). In the illustrated embodiment, the outer surface 632 is formed on an outer flange and a recess 634 is formed between the flange and a base 638 of the lens connector 630. The outer surface 632 extends across a gap between the edges of the first lens 526 and the second lens 530 at the interface, thereby preventing light from "leaking" through the gap and facilitating a seamless appearance between the lenses 526, 530.

The base 638 of the lens connector 630 includes a first extension 642 and a second extension 646. In the illustrated embodiment, the first extension 642 includes a first projection 650 and the second extension 646 includes a second projection 654. The projections 650, 654 are inclined with respect to their respective extensions 642, 646. The projections 650, 654 are also angled toward each other.

Returning to FIG. 12, a light mounting bracket 606 are coupled to the each of the housings 514, 518 so that side surfaces 609 of each light mounting bracket 606 are positioned proximate an external surface of each housing 514, 518. In other words, openings to the U-shaped housing 514, 518 and the U-shaped light mounting bracket 606 are proximate one another so that channel 636 and passage 608 are substantially the same. The light mounting bracket 606 is also wider than the housings 514, 518. The projections 622 are received within apertures 638 of the housing 514, 518 and engage the light mounting bracket 606, e.g., by a snap-fit, to couple the light mounting brackets 606 to the respective housings 514, 518.

Protuberances 626 are positioned between each of the side surfaces 609 and the main surface 607. The protuberances 626 are raised or protrude beyond a main surface 607 and protrude beyond the respective side surfaces 609. In other embodiments, the light mounting bracket 606 may instead include a concave formation.

The projections 650, 654 pass through holes 656 in the light mounting brackets 606 so that the lens connector 630 engages the light mounting bracket 606, e.g., by a snap-fit. The holes 656 are formed by the abutment of the light mounting brackets 606. The inclination of the projections 650, 654 secures the lens connector 630 to the light mounting bracket 606, so that the lens connector 630 cannot fall out of the holes 656.

The lenses 526, 530 are coupled to the housings 514, 518. In the illustrated embodiment, the lenses 526, 530 are coupled to their respective housings 514, 518 through the light mounting brackets 106. The pockets 582 of the lenses 526, 530 are substantially similar in shape to the protuberances 626 of the light mounting brackets 606, which allows one of the pockets 582 to engage or nest with the associated one of the protuberances 626. Each lens 526, 530 snaps onto one of the respective light mounting brackets 606 to couple the lens 526, 530 to the respective housing 514, 518. The pocket 582 receives the protuberance 626 so that a portion of the lens 26, 30 wraps around the protuberance 626. In the illustrated embodiment, each protuberance 626 has three sides. The projections 574 abut first surfaces of protuberances 626 (e.g., planar surfaces adjacent the main surface 607) and the bent portions 578 abut second surfaces of the protuberances 626 (e.g., an inclined surface adjacent the side surface 609), thereby securing each protuberance 626 within the associated pocket 582. In the illustrated embodiment, the first surfaces of the protuberances 626 and the projections 574 are both substantially planar surfaces, and the projections 574 lie flat against the respective first surface of each protuberance 626. The bent portions 578 are inclined at substantially the same angle as the second surfaces of the protuberances 626, allowing the bent portions 578 and the second surface of each protuberance 626 to substantially mate (i.e., the bent portions 578 and the second surfaces substantially contact each other along their length).

Contact between the projections 574, the bent portions 578 and the respective surfaces of the protuberances 626 limit movement of the lens relative to the housing 514, 518 in directions that are non-parallel to the axis 522 (e.g., in a vertical direction as shown in FIG. 12). In the illustrated embodiment, the nesting arrangement forces direct contact between the projections 574, the bent portions 578, and the respective surfaces of the protuberances 626 while the lenses 526, 530 are coupled to the light mounting bracket 606. The direct contact between these features 574, 578, 626 provides a snap-fit.

Figure 15:
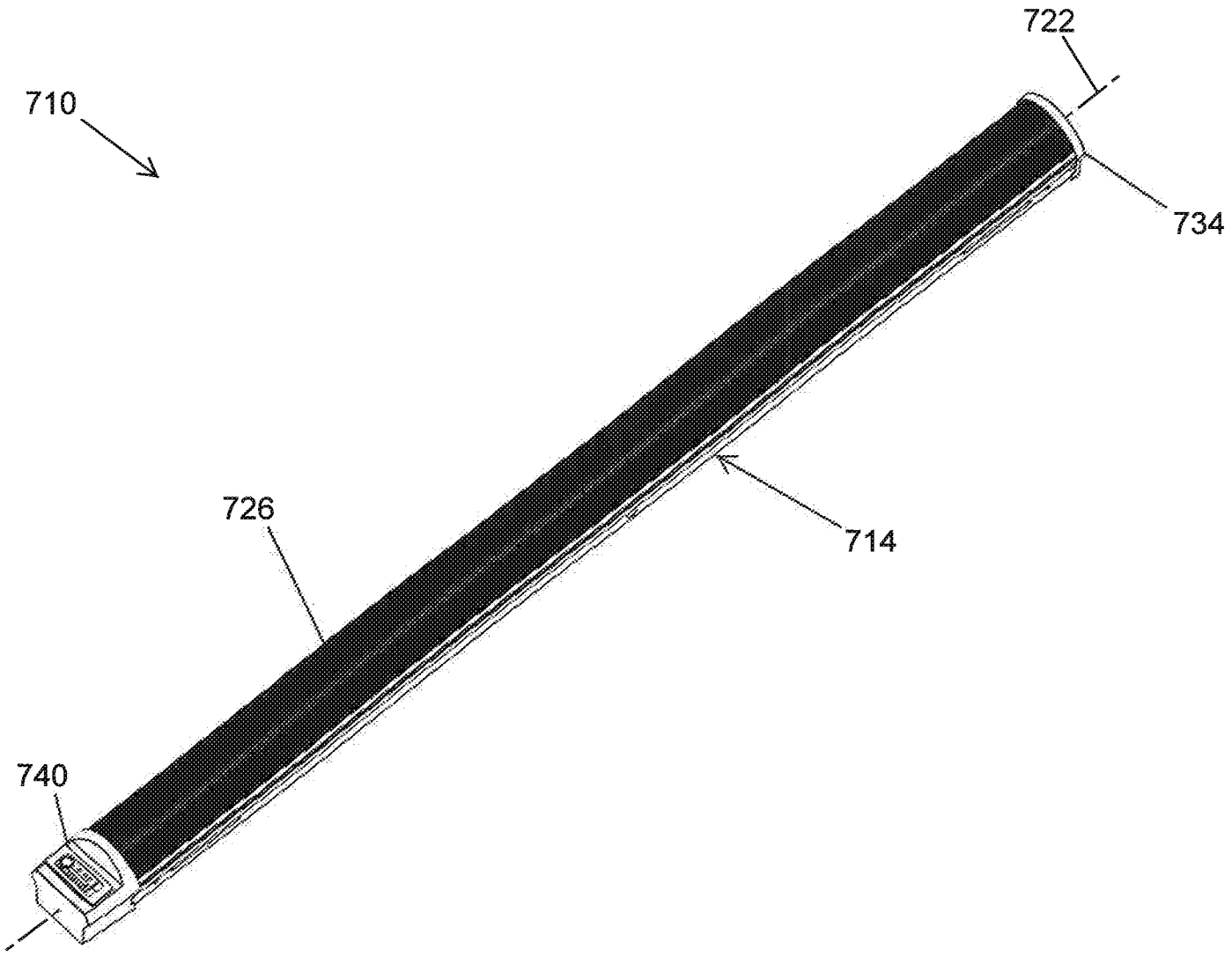
FIG. 15 is a perspective view of a luminaire according to another embodiment.

FIG. 15 illustrates a luminaire 710 according to another embodiment. At least some differences and similarities between luminaire 710 and luminaire 10 are described below. Similar features are identified with similar reference numbers, plus 700.

As shown in FIG. 15, luminaire 710 includes a housing 714 with an elongated body and that extends along an axis 722. A curved lens 726 is coupled to the housing 714 and extends parallel to the axis 722. The lens 726 and the housing 714 are coupled together in a substantially similar manner to the lens 26 and the housing 14 and are not repeated here for the sake of brevity. In the illustrated embodiment, the lens 726 is a curved narrow distribution lens. The narrow distribution lens 726 provides a different light output pattern than the lenses 26, 30 of the luminaire 10. An end cap 734 is coupled to one end of the housing 714. The end cap 734 and the housing 714 are coupled together in a substantially similar manner to the end cap 34 and the housing 14 and are not repeated here for the sake of brevity. A sensor 740 couples another end of the housing 714 opposite the end cap 734. In the illustrated embodiment, the sensor is an occupancy sensor and is configured to provide power to a light emitter (not shown) of the luminaire 710 after sensing movement.

Figure 16:
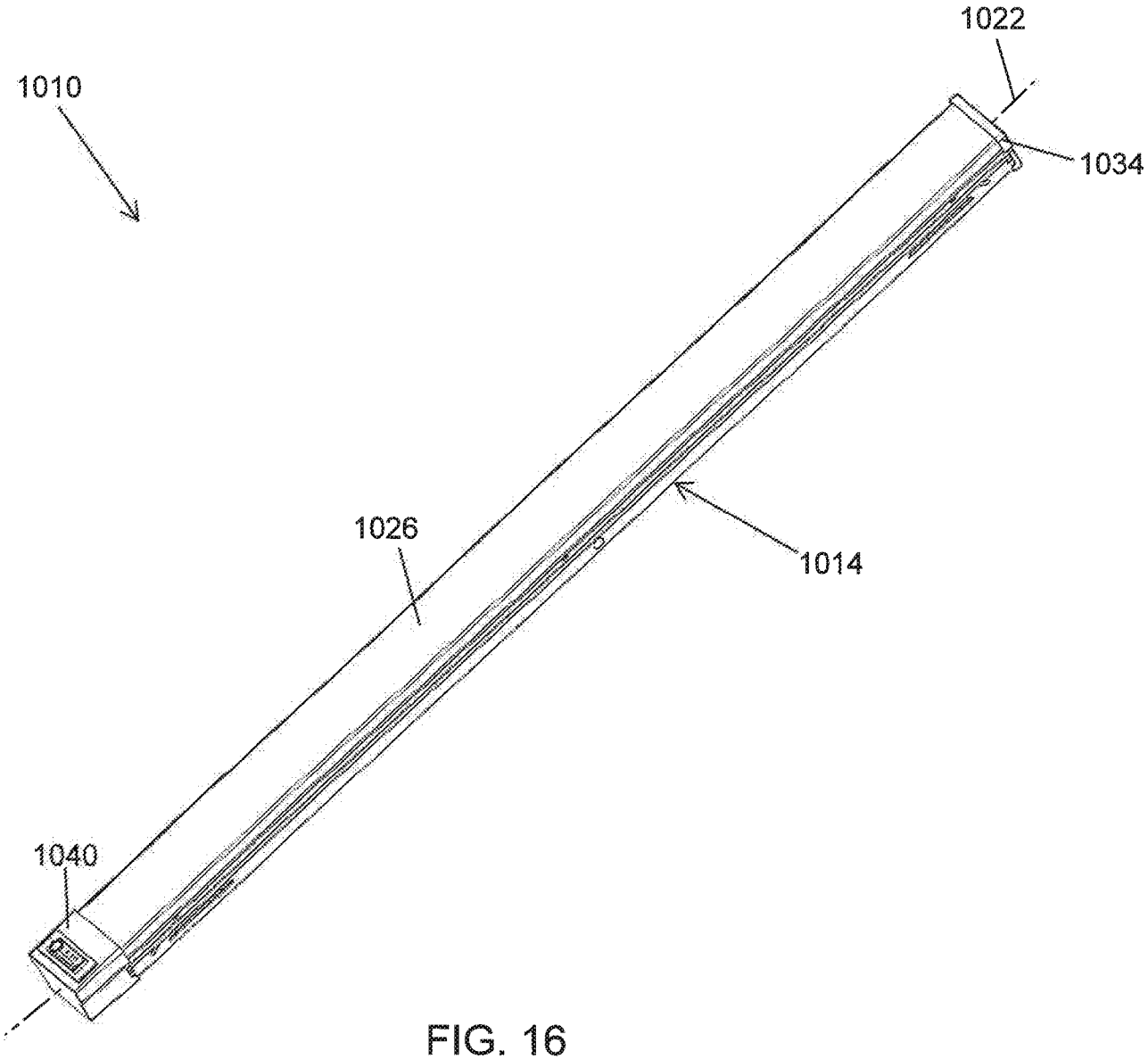
FIG. 16 is a perspective view of a luminaire according to another embodiment.

FIG. 16 illustrates a luminaire 1010 according to another embodiment. At least some differences and similarities between luminaire 1010 and luminaire 10 are described below. Similar features are identified with similar reference numbers, plus 1000.

As shown in FIG. 16, luminaire 1010 includes a housing 1014 with an elongated body and that extends along an axis 1022. A rectangular lens 1026 is coupled to the housing 1014 and extends parallel to the axis 1022. The lens 1026 and the housing 1014 are coupled together in a substantially similar manner to the lens 526 and the housing 514 and are not repeated here for the sake of brevity. In the illustrated embodiment, the lens 1026 is a curved narrow distribution lens. The narrow distribution lens 1026 provides a different light output pattern than the lenses 526, 530 of the luminaire 510. An end cap 1034 is coupled to one end of the housing 1014. The end cap 1034 and the housing 1014 are coupled together in a substantially similar manner to the end cap and the housing 514 and are not repeated here for the sake of brevity. A sensor 1040 couples another end of the housing 1014 opposite the end cap 1034. In the illustrated embodiment, the sensor is an occupancy sensor and is configured to provide power to a light emitter (not shown) of the luminaire 1010 after sensing movement.

The embodiment(s) described above and illustrated in the figures are presented by way of example only and are not intended as a limitation upon the concepts and principles of the present disclosure. As such, it will be appreciated that variations and modifications to the elements and their configuration and/or arrangement exist within the spirit and scope of one or more independent aspects as described.

What is claimed is:

1. A luminaire comprising, an elongated first housing supporting a first light emitting element, the first housing including a pair of sides, the first housing including a first aperture;

an elongated second housing including a pair of sides, an end of the second housing positioned adjacent an end of the first housing and including a second aperture disposed proximate the first aperture;

a bracket coupling the end of the first housing to the end of the second housing;

a first projection positioned on one of the bracket and the first housing;

a first aperture positioned on the other of the bracket and the first housing, the first aperture engaging the first projection by a snap-fit engagement to removably couple the bracket to the first housing;

a second projection positioned on one of the bracket and the second housing;

a second aperture positioned on the other of the bracket and the second housing, the second aperture engaging the second projection by a snap-fit engagement to removably couple the bracket to the second housing.

2. The luminaire of claim 1, wherein the projections have a half-hemispherical shape.

3. The luminaire of claim 1, wherein the end of the first housing and the end of the second housing abut one another while coupled to the bracket.

4. The luminaire of claim 1, wherein first housing, the second housing, and the bracket have a U-shaped profile, wherein a first channel is positioned between the pair of sides of the first housing, wherein a second channel is positioned between the pair of sides of the second housing, wherein the bracket nests within the first channel and the second channel.

5. The luminaire of claim 1, wherein the first projection and the second projection protrude in a direction away from a centerline of the first housing.

6. The luminaire of claim 1, wherein the first projection is positioned on a first portion of the bracket and the second projection is positioned on a second portion of the bracket.

7. The luminaire of claim 1, wherein the bracket further includes a curvilinear cutout.

8. The luminaire of claim 1, wherein the first projection and the second projection are positioned on a common surface of the bracket.

9. The luminaire of claim 1, further comprising a first mounting bracket including projections receivable within apertures of the first housing to provide a snap-fit connection, the first light emitting element coupled to a surface of the first mounting bracket.

10. A luminaire comprising, a housing including a first side and a second side;

a light emitter supported on the housing;

a lens removably coupled to the housing and at least partially covering the light emitter, the lens including a first side portion and a second side portion, the first side portion engaging the first side of the housing, the second side portion engaging the second side of the housing;

a pocket positioned on one of the first side portion of the lens and the first side of the housing; and a protuberance positioned on the other of the first side portion of the lens and the first side of the housing, the protuberance engageable with the one pocket to at least partially couple the lens to the housing.

11. The luminaire of claim 10, wherein the first side and the second side are parallel with respect to one another, and wherein the first side portion and the second side portion are parallel with respect to one another.

12. The luminaire of claim 10, wherein the housing further includes a mounting bracket, the housing further including a projection positioned on one of the mounting bracket and the first side, the housing further including an aperture positioned on the other of the mounting bracket and the first side, the projection engaging the aperture in a snap-fit connection to secure the mounting bracket to the first side.

13. The luminaire of claim 10, wherein the housing is a first housing and the lens is a first lens, the luminaire further comprising, a second housing including a pair of sides, the second housing positioned in an end-to-end orientation relative to the first housing;

a second light emitter supported on the second housing; and a second lens removably coupled to the second housing and at least partially covering the second light emitter, the second lens including a pair of side portions, each of the side portions engaging an associated one of the sides of the housing.

14. The luminaire of claim 13, further comprising a lens connector positioned adjacent an interface between the first lens and the second lens, the lens connector having substantially the same profile as the first lens and the second lens.

15. The luminaire of claim 10, wherein the lens has a planar surface oriented substantially parallel to a surface on which the light emitter is supported.

16. The luminaire of claim 10, wherein the pocket is formed by a projection and a bent portion spaced apart from the projection, the projection and the bent portion directly contact the protuberance when the protuberance is engaged with the pocket.

17. The luminaire of claim 10, wherein the pocket is formed on the first side portion of the lens and at least partially defined by a bent portion.

18. The luminaire of claim 10, wherein the pocket is at least partially defined by a planar projection configured to lie substantially flat against the protuberance.

* * * * *